US012509275B2

(12) United States Patent
Chung et al.

(10) Patent No.: US 12,509,275 B2
(45) Date of Patent: Dec. 30, 2025

(54) PACKAGING SYSTEM WITH SLIDABLE LATCH

(71) Applicant: Sonos, Inc., Santa Barbara, CA (US)

(72) Inventors: Matthew Ka-Ming Chung, Santa Barbara, CA (US); Jeremiah Robert Etchison, Santa Barbara, CA (US)

(73) Assignee: SONOS, INC., Goleta, CA (US)

( * ) Notice: Subject to any disclaimer, the term of this patent is extended or adjusted under 35 U.S.C. 154(b) by 223 days.

(21) Appl. No.: 18/172,507

(22) Filed: Feb. 22, 2023

(65) Prior Publication Data

US 2023/0264851 A1 Aug. 24, 2023

Related U.S. Application Data

(60) Provisional application No. 63/313,174, filed on Feb. 23, 2022.

(51) Int. Cl.

| | |
|---|---|
| ***B65D 5/64*** | (2006.01) |
| ***B65D 5/02*** | (2006.01) |
| ***B65D 5/44*** | (2006.01) |
| ***B65D 43/02*** | (2006.01) |

(52) U.S. Cl.
CPC ..... *B65D 5/64* (2013.01); *B65D 5/0254* (2013.01); *B65D 5/44* (2013.01); *B65D 43/0202* (2013.01)

(58) Field of Classification Search
CPC ..... B65D 5/643; B65D 43/12; B65D 43/20; B65D 33/24; B65D 25/005; B65D 3/261; B65D 5/6673; B65D 5/6617; B65D 5/6611; B65D 5/646; E05B 37/16
USPC ..... 220/324; 229/125.37, 21, 19
See application file for complete search history.

(56) References Cited

U.S. PATENT DOCUMENTS

| | | | |
|---|---|---|---|
| 5,440,644 | A | 8/1995 | Farinelli et al. |
| 5,761,320 | A | 6/1998 | Farinelli et al. |
| 5,923,902 | A | 7/1999 | Inagaki |
| 6,032,202 | A | 2/2000 | Lea et al. |
| 6,256,554 | B1 | 7/2001 | DiLorenzo |
| 6,404,811 | B1 | 6/2002 | Cvetko et al. |
| 6,469,633 | B1 | 10/2002 | Wachter |
| 6,522,886 | B1 | 2/2003 | Youngs et al. |
| 6,611,537 | B1 | 8/2003 | Edens et al. |
| 6,631,410 | B1 | 10/2003 | Kowalski et al. |
| 6,757,517 | B2 | 6/2004 | Chang |
| 6,778,869 | B2 | 8/2004 | Champion |
| 7,130,608 | B2 | 10/2006 | Hollstrom et al. |
| 7,130,616 | B2 | 10/2006 | Janik |
| 7,143,939 | B2 | 12/2006 | Henzerling |

(Continued)

FOREIGN PATENT DOCUMENTS

| | | |
|---|---|---|
| EP | 1389853 A1 | 2/2004 |
| WO | 200153994 | 7/2001 |

(Continued)

OTHER PUBLICATIONS

Audio Tron Quick Start Guide, Version 1.0, Mar. 2001, 24 pages.

(Continued)

*Primary Examiner* — Anthony D Stashick
*Assistant Examiner* — Raven Collins
(74) *Attorney, Agent, or Firm* — Workman Nydegger

(57) ABSTRACT

A packaging system includes box parts connected to one another by a latch assembly. A method is used for installing the box parts with the latch assembly in a packaging assembly.

10 Claims, 6 Drawing Sheets

(56) References Cited

U.S. PATENT DOCUMENTS

| | | | |
|---|---|---|---|
| 7,236,773 | B2 | 6/2007 | Thomas |
| 7,295,548 | B2 | 11/2007 | Blank et al. |
| 7,391,791 | B2 | 6/2008 | Balassanian et al. |
| 7,483,538 | B2 | 1/2009 | McCarty et al. |
| 7,571,014 | B1 | 8/2009 | Lambourne et al. |
| 7,630,501 | B2 | 12/2009 | Blank et al. |
| 7,643,894 | B2 | 1/2010 | Braithwaite et al. |
| 7,657,910 | B1 | 2/2010 | McAulay et al. |
| 7,853,341 | B2 | 12/2010 | McCarty et al. |
| 7,987,294 | B2 | 7/2011 | Bryce et al. |
| 8,014,423 | B2 | 9/2011 | Thaler et al. |
| 8,045,952 | B2 | 10/2011 | Qureshey et al. |
| 8,103,009 | B2 | 1/2012 | McCarty et al. |
| 8,234,395 | B2 | 7/2012 | Millington |
| 8,483,853 | B1 | 7/2013 | Lambourne |
| 8,942,252 | B2 | 1/2015 | Balassanian et al. |
| 2001/0042107 | A1 | 11/2001 | Palm |
| 2002/0022453 | A1 | 2/2002 | Balog et al. |
| 2002/0026442 | A1 | 2/2002 | Lipscomb et al. |
| 2002/0124097 | A1 | 9/2002 | Isely et al. |
| 2003/0157951 | A1 | 8/2003 | Hasty, Jr. |
| 2004/0024478 | A1 | 2/2004 | Hans et al. |
| 2007/0142944 | A1 | 6/2007 | Goldberg et al. |

FOREIGN PATENT DOCUMENTS

| | | | | |
|---|---|---|---|---|
| WO | 2003093950 | A2 | 11/2003 | |
| WO | WO-2016054464 | A1 * | 4/2016 | ..... B65D 43/12 |

OTHER PUBLICATIONS

AudioTron Reference Manual, Version 3.0, May 2002, 70 pages.
AudioTron Setup Guide, Version 3.0, May 2002, 38 pages.
Bluetooth. "Specification of the Bluetooth System: The ad hoc Scatternet for affordable and highly functional wireless connectivity," Core, Version 1.0 A, Jul. 26, 1999, 1068 pages.
Bluetooth. "Specification of the Bluetooth System: Wireless connections made easy," Core, Version 1.0 B, Dec. 1, 1999, 1076 pages.
Dell, Inc. "Dell Digital Audio Receiver: Reference Guide," Jun. 2000, 70 pages.
Dell, Inc. "Start Here," Jun. 2000, 2 pages.
"Denon 2003-2004 Product Catalog," Denon, 2003-2004, 44 pages.
Jo et al., "Synchronized One-to-many Media Streaming with Adaptive Playout Control," Proceedings of SPIE, 2002, pp. 71-82, vol. 4861.
Jones, Stephen, "Dell Digital Audio Receiver: Digital upgrade for your analog stereo," Analog Stereo, Jun. 24, 2000 http://www.reviewsonline.com/articles/961906864.htm retrieved Jun. 18, 2014, 2 pages.
Louderback, Jim, "Affordable Audio Receiver Furnishes Homes With MP3," TechTV Vault. Jun. 28, 2000 retrieved Jul. 10, 2014, 2 pages.
Palm, Inc., "Handbook for the Palm VII Handheld," May 2000, 311 pages.
Presentations at WinHEC 2000, May 2000, 138 pages.
*Sonos, Inc.* v. *DM Holdings* (No. 14-1330-RGA), DI 219, Claim Construction Opinion (Jan. 12, 2017) (24 pages).
U.S. Appl. No. 60/490,768, filed Jul. 28, 2003, entitled "Method for synchronizing audio playback between multiple networked devices," 13 pages.
U.S. Appl. No. 60/825,407, filed Sep. 12, 2006, entitled "Controlling and manipulating groupings in a multi-zone music or media system," 82 pages.
UPnP; "Universal Plug and Play Device Architecture," Jun. 8, 2000; version 1.0; Microsoft Corporation; pp. 1-54.
Yamaha DME 64 Owner's Manual; copyright 2004, 80 pages.
Yamaha DME Designer 3.5 setup manual guide; copyright 2004, 16 pages.
Yamaha DME Designer 3.5 User Manual; Copyright 2004, 507 pages.

* cited by examiner

PACKAGING SYSTEM WITH SLIDABLE LATCH

FIELD OF THE DISCLOSURE

The disclosure is related to packaging systems and, more particularly, to systems, methods, features, and other elements directed to packaging systems, including a sliding latch.

BACKGROUND

Packaging systems are commonly used to enclose products for distribution, storage, sale, and use. Despite some of the typical objectives of packaging systems to protect and/or preserve the products they contain, a packaging system may be designed to be opened to access the products inside.

There continues to be a need to develop packaging systems that are intuitive to use, easily reusable, and efficient to assemble.

BRIEF DESCRIPTION OF THE DRAWINGS

Features, aspects, and advantages of the presently disclosed technology may be better understood concerning the following description, appended claims, and accompanying drawings. A person skilled in the relevant art will understand that the features shown in the drawings are purposes of illustration, and variations, including different or additional features and arrangements thereof, are possible.

Figure 1A:
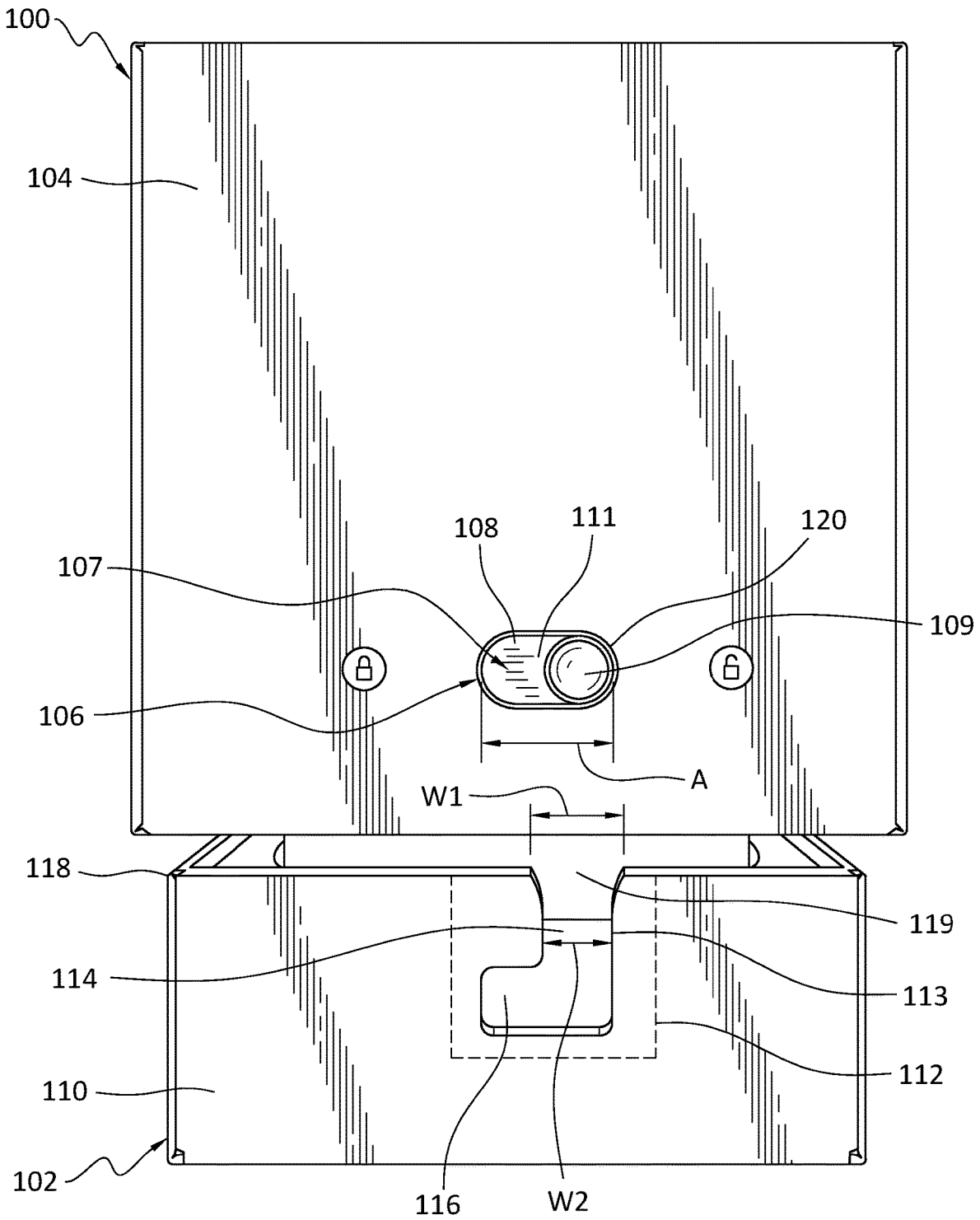
FIG. 1A shows a packaging system according to an exemplary implementation.

The drawings are to illustrate exemplary implementations and are not drawn to scale. It is understood that the inventions are not limited to the arrangements and instrumentalities shown in the drawings.

DETAILED DESCRIPTION

A better understanding of different embodiments of the disclosure may be had from the following description read with the drawings in which like reference characters refer to like elements.

While the disclosure is susceptible to various modifications and alternative constructions, certain illustrative embodiments are in the drawings and are described below. The dimensions, angles, and curvatures represented are to be understood as exemplary and are not necessarily shown in proportion.

It should be understood, however, there is no intention to limit the disclosure to the specific embodiments disclosed, but on the contrary, the intention covers all modifications, alternative constructions, and equivalents falling within the spirit and scope of the disclosure.

According to embodiments of the disclosure, a first box part and a second box part are provided with corresponding latch assembly components as an improvement over known locking mechanisms of a packaging system, with increased durability and speed of assembly. While described in a packaging system, the embodiments disclosed and the individual components thereof may likewise be extended to other systems.

Some examples described herein involve systems, methods, features, and other elements of packaging systems, including a sliding latch. In particular, a packaging system may include a first box part having walls, one or more of which may include an aperture with a latch that is slidable within the aperture. A second box part may also include walls, one or more of which may include a channel configured and dimensioned to receive the latch. The second box part may be further configured to fit within the first box part such that the latch is aligned with the channel. Further, the latch may slide within the aperture and the channel when the box parts are fitted together to a position where the latch may resist the separation of the box parts. Thus, the latch may be configured to "lock" the box parts together.

As indicated above, the examples involve packaging systems, including a sliding latch. In one aspect, a packaging system includes 1) a first box part including a plurality of lid walls, where a first lid wall includes an aperture; 2) a latch slidably disposed within the aperture; and 3) a second box part including a plurality of tray walls, where a first tray wall includes a channel configured and dimensioned to slidably receive the latch, where the channel includes an assembly channel segment and a locking channel segment, where the assembly channel segment intersects an edge of the first tray wall, where the second box part is configured to fit within the first box part such that a) the assembly channel segment is aligned with the latch when the latch is in a first position within the aperture, and b) the latch is slidable within the locking channel segment to a second position.

In another aspect, a method involves 1) preparing a first blank for a first box part, the first box part including a plurality of lid walls, where a first lid wall includes an aperture; 2) preparing a second blank for a second box part, the second box part including a plurality of tray walls, where a first tray wall includes a channel configured and dimensioned to slidably receive the latch, where the channel includes an assembly channel segment and a locking channel segment, where the assembly channel segment intersects an edge of the first tray wall; 3) disposing a latch within the aperture such that the latch is slidable within the aperture; 4) forming the first box part from the first blank; and 5) forming the second box part from the second blank, where the formed second box part is configured to fit within the formed first box part such that a) the assembly channel segment is aligned with the latch when the latch is in a first position within the aperture, and 2) the latch is slidable within the locking channel segment to a second position.

In yet another aspect, another method involves 1) fitting a second box part within a first box part, where the first box part includes a plurality of lid walls, where a first lid wall includes an aperture, where a latch is slidably disposed within the aperture, where the second box part includes a plurality of tray walls, where a first tray wall includes a channel configured and dimensioned to slidably receive the latch, where the channel includes an assembly channel segment and a locking channel segment, where the assembly channel segment intersects an edge of the first tray wall, and where the second box part is configured to fit within the first box part such that a) the assembly channel segment is aligned with the latch when the latch is in a first position within the aperture, and b) the latch is slidable within the locking channel segment to a second position; and 2) sliding the latch within the aperture to the second position, where sliding the latch within the aperture further includes sliding the latch within the locking channel segment.

Referring to FIG. 1A, a packaging system with a sliding latch includes a first box part 100, a second box part 102, and a latch assembly 107. In an assembled condition, the first box part 100 is configured to receive the second box part 102 such that the second box part 102 is fitted within the first box part 100. At the same time, the latch assembly 107 is coupled to the first box part 100 and configured to secure the second box part 102 to the first box part 100. The latch assembly 107, according to embodiments of the disclosure, may comprise a latch member ("latch 108") and a plate 202, the latch assembly 107 configured to be intimately coupled and slidably disposed within an aperture 106 of the first box part 100.

Figure 1B:
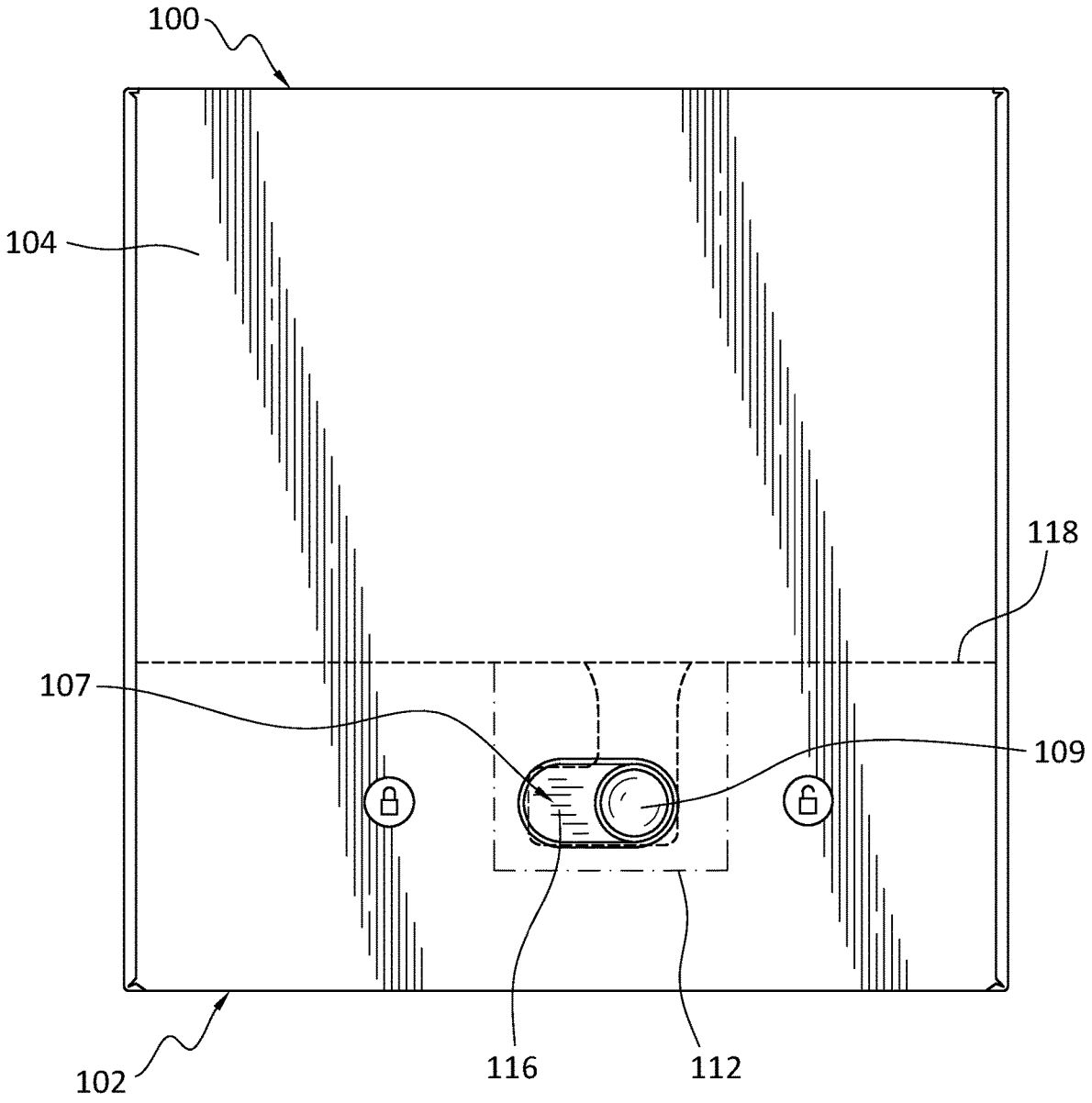
FIG. 1B shows a packaging system according to an exemplary implementation

Although the first box part 100 in FIGS. 1A and 1B is generally referred to herein as the "lid" and the second box part 102 is generally referred to as the "tray", this is for exemplary purposes only. These labels may be orientation-dependent and describe one of many possible configurations. The first box part 100 and the second box part 102 may be a "right side" and "left side," and may be fitted together horizontally instead of vertically. Moreover, in some examples, the first box part 100 and the second box part 102 may not be separable components as shown in FIG. 1A. Rather, they may be two parts of a single, integral packaging system. For example, the first box part 100 may be a flap that is attached to, and slides into or over, the second box part 102. Other examples are also possible.

The first box part 100 may include walls, one or more of which may be a first lid wall 104 defining an aperture 106. Further, a latch assembly 107 may be installed within the lid wall 104 by displacing a locking tab located within the first box part 100 and slidably inserting the latch assembly 107 into the available window. The latch 108 component of the latch assembly 107 may include a projection portion, such as a thumb or finger tab 109; a body portion 111 integral with the finger tab 109 extending into the first box part 100, which can be seen more clearly in FIGS. 2A-2D; and a latch engagement portion 224 extending from the body portion 111 opposite the finger tab 109 into the second box part 102, which may be seen more clearly in FIGS. 2A-2D. The finger tab 109 may project at least partially beyond the aperture 106 in a direction perpendicular to the plane of the page. Alternatively, the finger tab 109 may be fully recessed within the aperture 106.

In some cases, as shown in FIG. 1A, the latch 108 may be slidable within the aperture 106 along a single axis. For example, as shown in FIG. 1A, the latch 108 may slide horizontally, to the left and right, as indicated by arrow A. In other examples, the aperture 106 may have a shape that includes more than one axis, such as an "L" or a "T" shape, among other shapes. Accordingly, the latch 108 may be slidable within the aperture 106 along a plurality of axes. The aperture 106 may additionally or alternatively include one or more arc segments (not shown) such that the latch 108 is slidable within the aperture 106 along a curve. Other possibilities exist.

Generally, the aperture 106 is an opening defined by the first lid wall 104. The aperture 106 has at least two endpoints which may share the same geometric profile as the finger tab 109, the endpoints being separated by width portion larger than the finger tab 109. For example, the aperture 106 may be defined as a shape made up of two semicircles separated by parallel lines to be configured with a circular finger tab 109 as shown in FIG. 1A. In other examples, the aperture 106 may be defined as a rectangle with rounded corners to be configured with a square finger tab having rounded corners. Alternatively, the geometry of the aperture 106 may be defined by the outer profile of an aperture 120 of the latch assembly 107 such that the aperture 120 may securely fit within the aperture 106 and act as a buffer between the finger tab 109 and the aperture 106 as shown in FIG. 1A. Other possibilities exist.

The first box part 100 may be, for example, paper, paperboard, cardboard, fiberboard, or the like and formed out of a first blank as described in greater detail below. The first box part 100 may be corrugated, uncorrugated, or a combination thereof. Alternatively, the first box part 100 may be plastic. Other examples are also possible.

The first box part 100 shown in FIG. 1A is shown as a hollow cuboid; however numerous other shapes (e.g., cube, pyramid, cylinder, etc.) with different configurations and/or different numbers of walls are also possible. Further, the first box part 100 might not include walls on each of its sides, such that the first box part 100 is not fully enclosed. That is, the first box part 100 may have one or more sides that do not include a wall. For example, the cube-shaped first box part 100 shown in FIG. 1A may include of only five lid walls such that the first box part 100 may receive the second box part 102. Other examples and configurations are also possible.

Similarly, the second box part 102 may be made from a second blank using any of the materials, shapes, or configurations used by the first box part 100, as discussed above. As shown in FIG. 1A, the second box part 102 may include five tray walls that generally define a hollow cube with an open top. One or more of the tray walls may be a first tray wall 110 comprising a channel region 112 that includes a guide channel 113 configured to slidably receive the latch 108, including at least a portion of the latch 108 that may extend into the second box part 102. The guide channel 113 may have an assembly channel segment 114 and a locking channel segment 116 in communication with assembly channel segment 114. Further, the assembly channel segment 114 may intersect an edge 118 of the first tray wall 110 adjacent an opening 119 configured to receive a portion of the latch 108, as described in greater detail below.

As shown in FIG. 1A, the assembly channel segment 114 and the locking channel segment 116 are complete cut-outs from the first tray wall 110. However, in some implementations the channel segments 114, 116 may instead be a depression or a groove in the first tray wall 110, among other arrangements. For example, in some cases the first tray wall 110 may be multi-layered such that its cross-section is composed of two or more adjacent walls. In such a case, one or both channel segments 114, 116 may include a cut-out of some but not all of the layers in the first tray wall 110. Other examples are also possible.

Additionally, the guide channel 113 may be chamfered, as shown in FIG. 1A, such that it has a first width W1 at the opening 119 along the edge 118 of the first tray wall 110, and a second, smaller width W2 away from the edge 118 of the first tray wall 110. This widening of the assembly channel segment 114 where it intersects the edge 118 of the first tray wall 110 may facilitate the proper alignment of the latch 108 into the assembly channel segment 114 when the box parts are fitted together. Other geometric examples may widen the assembly channel segment 114 at the edge 118, such as filleted corners, which are also possible.

In some examples, the first tray wall 110 may further include a channel liner 204 that is coupled to the first tray wall 110 to facilitate the sliding of the latch 108 within the guide channel 113. FIGS. 2A-2D show an exemplary channel liner 204, which is configured to follow the shape of both the assembly channel segment 114 and the locking channel segment 116. Further, as shown in FIGS. 1A and 2C, the channel liner 204 may include a relatively greater width at its top, where its width may correspond to the widened top of the assembly channel segment 114.

The first tray wall 110 may include two or more adjacent walls, such as the inner tray wall 110A and the outer tray wall 110B. The channel liner 204 may include a positioning flange 228 that is disposed between the inner tray wall 110A and the outer tray wall 110B, as shown in FIG. 2C. This arrangement may serve to couple the channel liner 204 to the first tray wall 110 and hold the channel liner 204 in place. In other examples, the channel liner 204 may include a channel front plate and a channel back plate that may be coupled together in a way that further couples them to the second box part 102.

In an example, a channel front plate and channel back plate may be substantially co-planar with the first tray wall 110, and may be coupled together such that the first tray wall 110 is between the channel front plate and the channel back plate, the channel front and back plates being aligned. In this way, the channel front plate and the channel back plate may be coupled to the second box part 102 in a substantially fixed position via contact with the first tray walls 110. The channel front plate and channel back plate may be coupled together via glue, mechanical fasteners, or as a result of their integration into the first tray wall 110. Other examples are also possible.

Figure 2A:
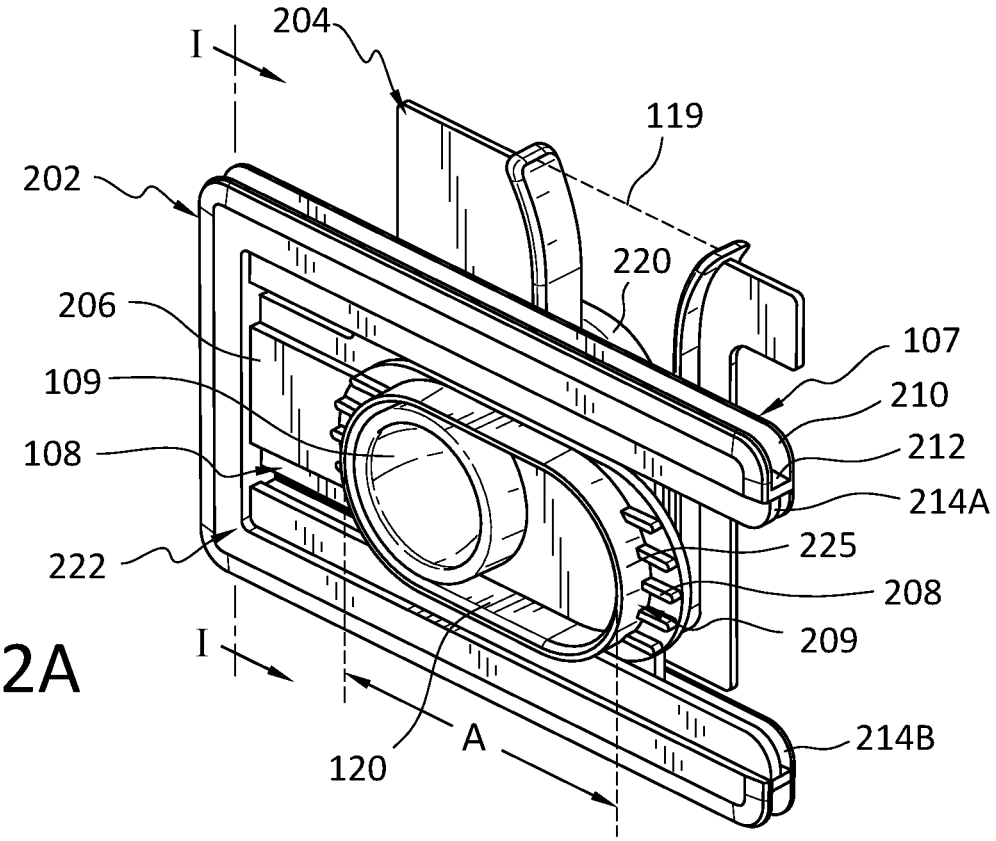
FIG. 2A shows a perspective view of coupled parts used in a packaging system according to an exemplary implementation.
Figure 2B:
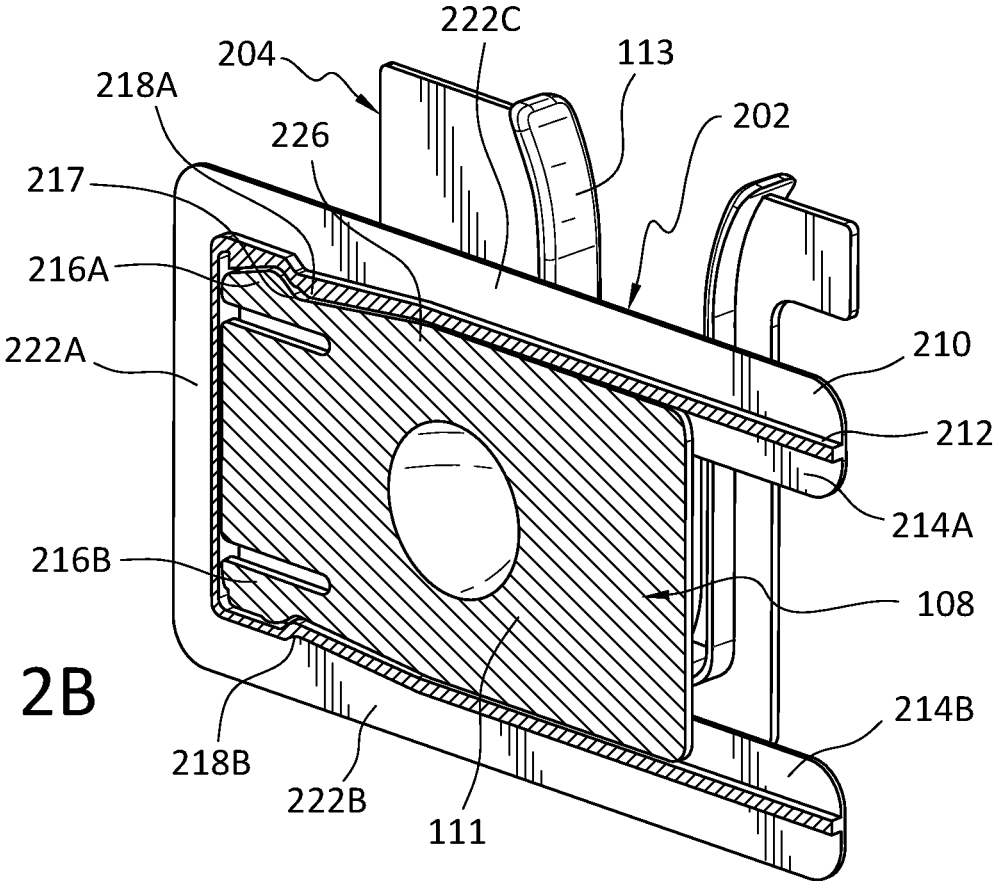
FIG. 2B shows a cross-sectional view along line I-I of coupled parts used in a packaging system according to an exemplary implementation.
Figure 2C:
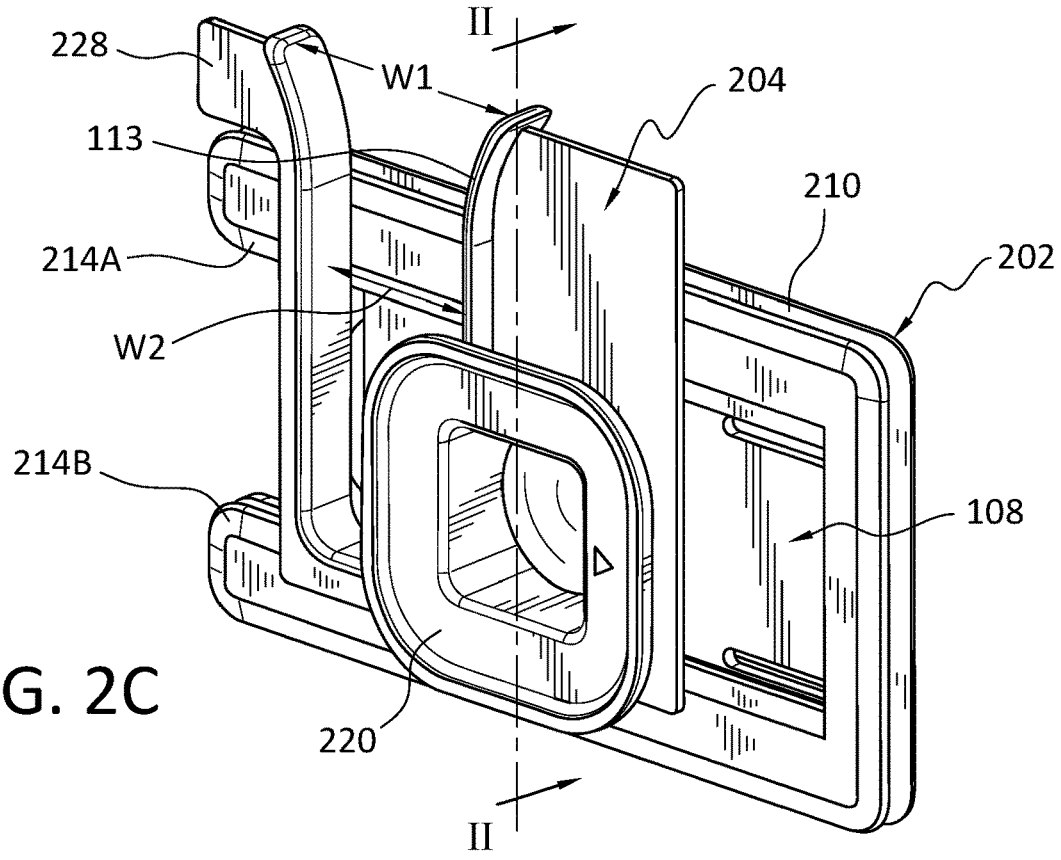
FIG. 2C shows a perspective view of coupled parts used in a packaging system according to an exemplary implementation.

Referring to FIGS. 2A-2B, the latch assembly 107 may be assembled by coupling a latch 108 with a plate 202. FIG. 2A shows an exemplary plate 202 comprising a frame 222 and a flap 209.

A plate 202 may comprise a frame 222 having outer frame portions 222A-222C (collectively "frame 222"). The second and third frame portions 222B, 222C extend generally perpendicularly from opposite ends of the first frame portion 222A and in parallel with one another. The plate 202 further includes an integral flap portion 209 ("flap 209") extending from the first frame portion 222A between the second and third frame portions 222B, 222C via a flexible hinge 206. The flap 209 includes an outer edge 225 defining an aperture 120 into which the finger tab 109 (FIG. 1A) of the latch 108 is received when inserted into the plate 202, as shown in FIG. 2A. The plate 202 may be substantially co-planar with the first lid wall 104 (FIG. 1A), and the plate 202 and the first lid wall 104 may be fit together such that the aperture 106 of the first lid wall 104 and the aperture 120 of the plate 202 are substantially aligned.

Additionally, the plate 202 may include a front face and a rear face separated by a thickness defining an interior and exterior rim. The interior rim is defined by the interior surfaces of the first, second, and third frame portions 222A, 222B, 222C and the exterior rim is defined by the exterior surfaces of the first, second, and third frame portions 222A, 222B, 222C. At least one slot 214 may be located within the interior rim of the second and third frame portions 222B, 222C configured and dimensioned to slidably receive the body portion 111 of the latch 108. A groove 210 may be located along the exterior rim of the frame 222 located between the front and rear faces of the frame 222. The groove 210 and the at least one slot 214 may be separated by a glide projection 212 configured to direct the latch 108 as it is slidably inserted into the at least one slot 214. For instance, the exemplary frame 222 shown in FIGS. 2A-2D has two parallel slots 214A, 214B located along the interior rim of the frame 222 separated from the groove 210 by a thin protrusion defining the glide projection 212.

Although FIGS. 2A-2D show an exemplary plate 202 having a substantially rectangular frame 222, the frame 222 may be in the form of alternative substantially two-dimensional geometric shapes having different configurations and/or a different number of walls including, but not limited to, "V" shapes, "C" shapes, etc. Other shapes and configurations for the frame 222 are also possible.

Similarly, the hinge 206 may take a variety of forms and be made from various materials, including, but not limited to, plastic, metals, or a combination thereof. An exemplary hinge shown in FIG. 2A is made of a thin plastic that is able to swivel around the frame 222 and return to its resting position extending in-plane with the frame 222. The flexibility of the exemplary hinge shown in FIG. 2A allows for the hinge to be removed from the path of the latch 108 as the latch 108 is slidably inserted into the slot 214 of the frame 222 and to return to its resting position such that latch 108 is disposed within the aperture 120 thereby intimately coupling the latch 108 to the plate 202.

The flap 209 may also include a ridges or texture elements 208. The texture elements 208 may be configured to provide additional gripping force when the latch assembly 107 is coupled with the first box part 100. For example, when a latch assembly 107 having an exemplary texture, as shown in FIG. 2A is coupled with a first box part 100, the texture elements 208 engages with the interior surface of the first lid wall 104 thereby providing additional gripping means to secure the latch assembly 107 to the first box part 100.

Although the aperture 120 of the latch assembly 107 has been shown in FIG. 2A to have an elongated circular shape to allow for the latch 108 to have a circular shape to move along a single axis. Other shapes and configurations for the aperture 120 are also possible. For example, an exemplary aperture 120 may have a substantially rectangular shape with rounded corners. A latch 108 has a square shape with rounded corners to move along a single axis. The aperture 120 may also accommodate movement in a plurality of axes if desired, including, but not limited to, "T" shapes and "L" shapes. The aperture 120 may also be in any shape used for the aperture 106.

Furthermore, the exterior profile of the outer edge 225 is not required to share the same profile as the interior profile of the outer edge 225. Rather, the profile of the aperture 120 may have a first geometric profile of the outer edge 225 for engaging with the finger tab 109 of the latch 108 and a second geometric profile of the outer edge 225 for engaging with the aperture 106 of the first box part 100. For example, the interior profile of the outer edge 225 may be defined as two semicircles separated by parallel lines to receive a circular finger tab 109 as shown in FIGS. 1A-2A while the exterior profile of the outer edge 225 may be defined as a rectangle (not shown). If the exterior profile of the outer edge 225 differs from that of the interior profile of the outer edge 225, the aperture 106 will have a geometric profile configured to correspond with that of the outer edge 225.

The width of the groove 210 may be limited by the thickness of the frame 222 and may approximately be the same thickness as the first lid wall 104. The groove 210 allows for the plate 202 of the latch assembly 107 to be easily inserted into a window located on an inner wall portion of the first box part 100. Other configurations altering the number, length, and width of grooves 210 are also possible. For instance, the wall thickness immediately around the window 308 located on an inner wall portion of the first lid wall 104 may be different than the remaining thickness of the inner wall portion.

As discussed above, the latch 108 may comprise a body portion 111, a finger tab 109 extending from the body portion 111, and a latch engagement portion 224 extending from the body portion 111 opposite the finger tab 109, culminating in an interior flange 220. In some embodiments, the body portion 111 may be substantially planar, including a sliding flange 226 that inserts into the slot 214 of the plate 202. The sliding flange 226 is substantially co-planar with the frame 222 and slidably contained when inserted into the slot 214. In such embodiments, the body portion 111 has a thickness less than that of the glide projection 212 of the plate 202 such that the latch 108 may be slidably inserted within the slot 214.

The sliding flange 226 may facilitate sliding of the latch 108 laterally within the aperture 106. Further, this configuration may allow the latch 108 to resist sagittal movements that might otherwise cause the latch 108 to fall out of (or into) the first lid wall 104. Other configurations and arrangements for keeping the latch 108 disposed of within the aperture 106 are also possible.

The finger tab 109 may be configured and dimensioned to fit within the aperture 120 of the plate 202. For example, the finger tab 109 may define an interaction cavity that is circular in shape as shown in FIGS. 1A-2A. Other configurations for the finger tab 109 are also possible. For instance, an exemplary latch 108 may have a finger tab 109 with a square interaction cavity with rounded corners.

Figure 2D:
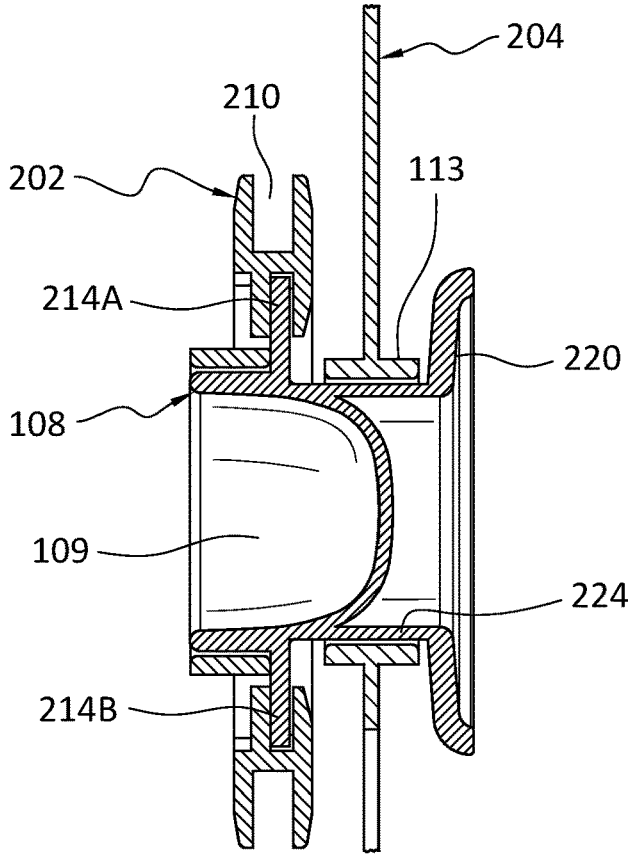
FIG. 2D shows a cross-sectional view along line II-II of coupled parts used in a packaging system according to an exemplary implementation.

Additionally, the latch 108 may be configured to have a variety of depths, widths, and textures. For instance, in one implementation, the finger tab 109 may be configured to have a circumference of four inches to allow a user with larger fingers to grip the latch 108 better. Similarly, a finger tab 109 may be designed to have a depth of two inches to allow a user to better grip and manipulate the latch 108 as shown in FIG. 2D. The improvements made to the design of the latch assembly 107 increased efficiency and ergonomics by changing the shape and reducing the size of the latch 108 and plate 202, and increasing the depth of the cavity of the finger tab 109 for users to have a better grip or better manipulate the latch 108.

The latch engagement portion 224 may have a length approximate to the combined thickness of half of the plate 202 and either a channel liner 204 or the first lid wall 104 such that the interior flange 220 sufficiently engages with either the channel liner 204 or the first lid wall 104 to keep the first box part 100 and second box part 102 securely coupled. Additionally, the latch engagement portion has a cross-sectional profile configured and dimensioned to fit within the guide channel 113 of the second box part 102 or of a channel liner 204 as shown in FIG. 2D. The interior flange 220 may have a larger circumference or surface area than the finger tab 109 as shown in FIGS. 2C and 2D.

In some examples, the interior flange 220 extending from the latch engagement portion 224 may be disposed within the first tray wall 110 when the second box part 102 is fitted within the first box part 100. FIGS. 2A-2D show an example of the interior flange 220, which is disposed on the inside of the inner tray wall 110A (the channel liner 204 illustrating where the first tray wall 110 is located with the interior flange 220 extending through the thickness of the first tray wall 110). The interior flange 220 may serve to maintain the position of the finger tab 109 within the apertures 106, 120 while still allowing the latch 108 to slide laterally within the apertures 106, 120. The interior flange 220 may be included on the latch in addition to, or instead of, the sliding flange 226.

Figure 6:
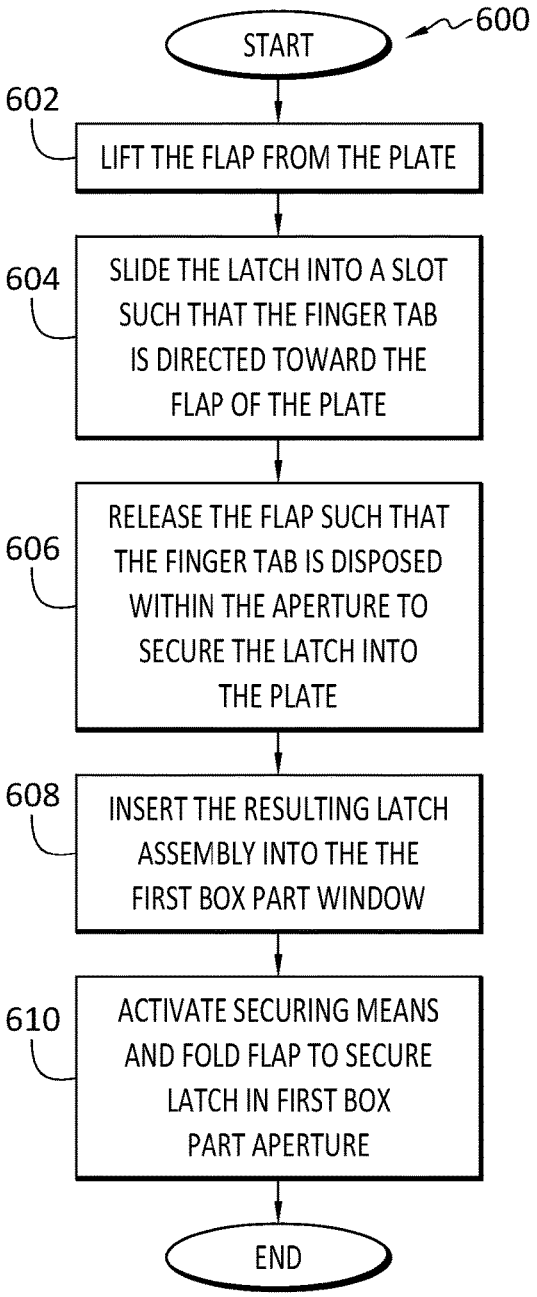
FIG. 6 shows a flow diagram according to an exemplary implementation.

The plate 202 and the latch 108 may be coupled together by following blocks 602, 604, and 606 of the method in FIG. 6. For example, by lifting the flap 209 away from the plate 202 such that the flap 209 swivels about the frame 222, slidably inserting the latch 108 into the one or more slots 214 while the finger tab side of the latch 108 corresponds to the flap side of the plate 202, and returning the flap 209 to its original position such that the finger tab 109 is securely and slidably disposed within the aperture 120, as seen in FIG. 2A.

The improved latch assembly 107 shown in FIGS. 2A-3B has significant advantages and overcomes the limitations of previous solutions. The advantages of the improved latch assembly 107 include reducing the molded component count, size, cost, and required packaging support components; updating the visual design and ergonomics to enhance the user's experience; enhancing and streamlining the assembly and disassembly process; and enhancing recyclability.

The improved latch assembly 107 improves the overall strength of the packaging system during transportation because of the requisite reduced number of parts. The latch assembly 107 only requires a single plate and latch, intimately coupled. Other latch assemblies may be assembled from three distinct parts: a front plate, a back plate, and a latch, wherein the latch is placed into the interior cavity of either the front or back plate and "secured" in place by coupling the front and back plates together. These previous iterations were more prone to fail during shipping or transit due to the uncoupling of the front and back plates. The improved latch assembly 107 avoids these problems by eliminating one of the plates (front or back) by redesigning the plate such that a flap 209 intimately couples the latch 108 such that the improved latch assembly 107 will not be so readily uncoupled thereby decreasing the security of the packaging system.

In some implementations, the latch 108 may include one or more features configured to engage a corresponding feature in the plate 202 and/or the first lid wall 104. Referring to FIG. 2B, the plate 202 may include two locking features 216A, 216B located at opposites sides of the sliding flange 226, such as spring-loaded tabs formed separated from the body of the sliding flange 226 by a notch 217. The locking features 216A, 216B may be located elsewhere on the latch 108, and may further be included on an exemplary latch that does not include a sliding flange 226. Additionally, the plate 202 in FIG. 2A includes two protrusions 218A, 218B configured to engage the corresponding locking features 216A, 216B.

In an example that does not include a plate 202, the protrusions may be located elsewhere on the first lid wall 104, perhaps on the outer wall portion 104A or the inner wall portion 104B. More or fewer protrusions and locking features are possible. Alternatively, the at least one protrusion or protrusions may be located on the latch 108, and the at least one notch or notches located on the first lid wall 104. In yet other alternatives, there may be a combination of notches and/or latches on one or both parts.

The opposing locking features 216 and protrusions 218, when engaged, may serve to resist (but not entirely prevent) the sliding of the latch 108 when it is in certain positions within the aperture 106. As seen in FIG. 2B, the locking features 216A, 216B and the corresponding protrusions 218A, 218B may be engaged when the latch 108 is in the second position, at the left side of the aperture 106. This may be the "locked" position. This arrangement may serve to maintain the latch 108 in the second, "locked" position such that it cannot freely slide into an "unlocked" position. The latch 108 may slide out of the second position by applying a minimal force to the latch 108 to overcome the resistance caused by the notches and protrusions.

Accordingly, sliding the latch within the aperture at block 704 of the method 700 may involve sliding the latch such that at least one locking feature 216 having a detent or ramp located on the latch 108 engages at least one protrusion 218 of the frame 222.

Alternatively, the locking features 216 and protrusions 218 might be configured such that they are engaged when the latch 108 is in the first position within the aperture 106. For example, two of the locking features 216A, 216B and two of the protrusions 218A, 218B may be engaged when the latch 108 is, at the right side of the aperture 106. This may be the "unlocked" position. This arrangement may serve to keep the latch 108 generally aligned with the assembly channel segment 114 for greater ease of fitting the box parts together. Again, the latch 108 may slide out of the first position by applying a relatively minimal force to the latch 108 to overcome the resistance caused by the locking features 216 and protrusions 218.

Referring to FIGS. 3-6, the first box part 100 and second box part 102 may be formed from a first blank 302 and a second blank 402, respectively. For example, at block 502 of the method 500 shown in FIG. 5 may involve preparing a first blank 302 for the first box part 100. The first blank 302 may be a flat and relatively featureless sheet of paper, cardboard, fiberboard, or the like. It may be corrugated, uncorrugated, or a combination thereof. The first blank 302 may alternatively be plastic. Other examples are also possible.

Preparing the first blank 302 may involve cutting the first blank 302 into a predetermined shape and scoring the first blank 302 with lines along which the first blank 302 may be folded to form the first box part 100. For example, a first blank 302 may be formed into a first box part 100 that is cuboid in shape and includes five lid walls. The first blank 302 is cut along predetermined cut lines 306A-F and scored along predetermined fold lines 304A-L. In some examples, one or more of the lid walls of the first box part 100 may include a pair of adjacent walls. Accordingly, the first blank 302 may comprise a pair of walls that, when folded onto one another along a predetermined fold line 304L, 304H form a first lid wall 104 of the first box part 100. Other examples, including a different shape or number of walls, are also possible.

Figure 3:
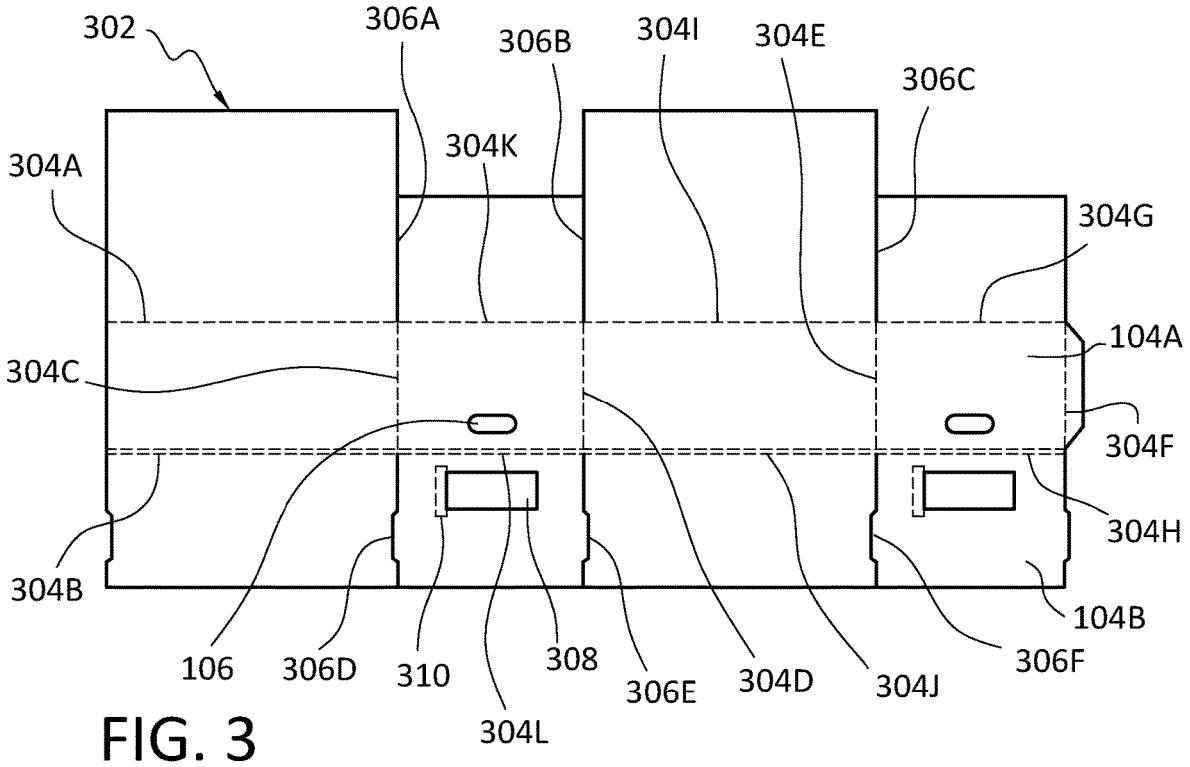
FIG. 3 shows a front view of a first blank used in a packaging system according to an exemplary implementation.

One or more apertures 106 and windows 308 may be cut into the first blank 302 as shown by FIG. 3. In one example, a pair of wall portions may form the first lid wall 104, each defining an aperture 106 and a window 308 respectively. The apertures 106 and windows 308 may be folded together along a predetermined fold line 304L, 304H, as noted above. Further, the first blank 302 may be formed into a first box part 100 that includes two apertures 106 on opposing lid walls. Preparing the first blank 302 may also involve printing logos, product information, and the like onto the blank. Other possibilities also exist.

Figure 4:
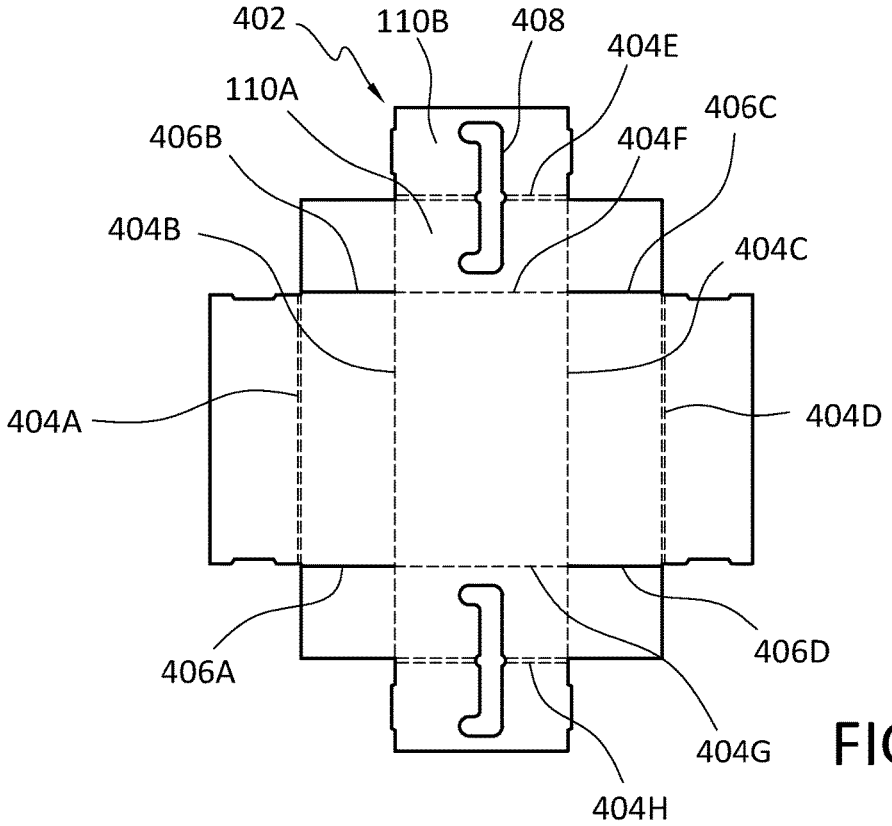
FIG. 4 shows a front view of a second blank used in a packaging system according to an exemplary implementation.
Figure 5:
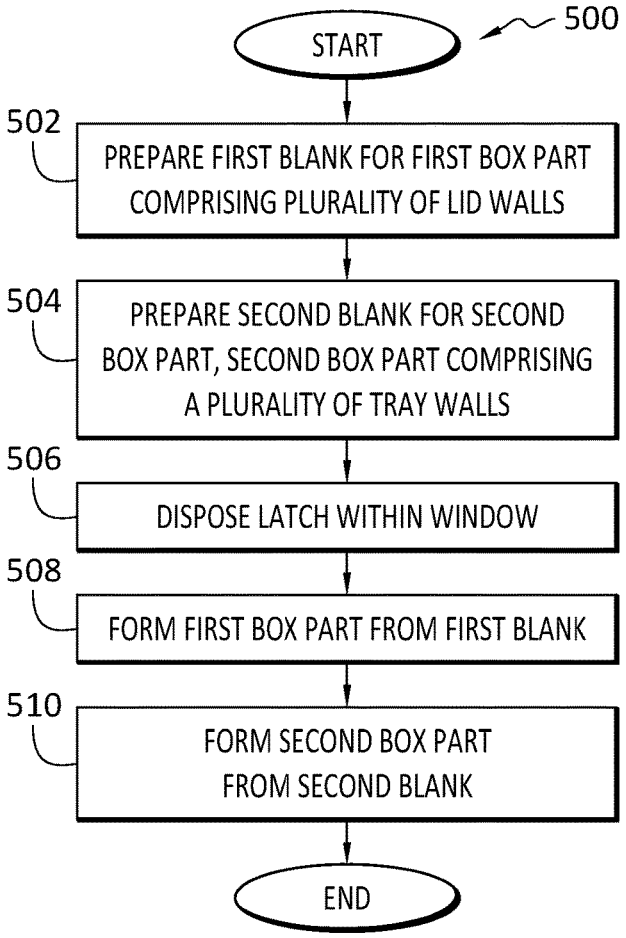
FIG. 5 shows a flow diagram according to an exemplary implementation.

Block 504 of the method 500 shown in FIG. 5 may involve preparing a second blank 402 for a second box part 102. The second blank 402 may be largely similar to the preparation of the first blank 302 as discussed above. FIG. 4 shows a second blank 402 that is cut along lines 406A-D and scored along lines 404A-H. The second blank 402 may then be folded along lines 404A-H to form five tray walls of a second box part 102. Like the first blank 302, the second blank 402 includes several pairs of walls that may be folded to form a first tray wall 110 of the second box part 102.

Preparation of the second blank 402 may further include cutting one or more guide channels 113 into the second blank 402 that are configured and dimensioned to slidably receive a latch 108, as discussed above. FIG. 4 shows a cut-out 408 that may form a guide channel 113 in the first tray wall 110 when the corresponding walls are folded onto one another along line 404E, 404H. As discussed above, the guide channel 113 may further include an assembly channel segment 114 and a locking channel segment 116.

Block 506 of the method 500 shown in FIG. 5, may involve disposing the latch assembly 107 within the window 308 of the first blank 302 such that the finger tab 109 of the latch 108 is disposed within the aperture 106 after the first box part 100 is assembled. In some examples, the latch 108 may alternatively be disposed within the aperture 106, as the two apertures 106, 120 will ultimately be adjacent to one another. Other examples are also possible.

The first lid wall 104 includes adjacent wall portions (identified individually as an outer wall portion 104A and an inner wall portion 104B). The inner wall portion 104B is configured to fold over the outer wall portion 104A such that the latch assembly 107 is sandwiched between the two wall portions 104A, 104B when installed in the first lid wall 104. Further, the inner wall portion 104B defines the window 308 and the foldable locking tab 310 adjacent the window 308 that receives the plate 202 of the latch assembly 107.

Disposing the latch 108 within the aperture 106 may involve forming the latch assembly 107 by coupling a plate 202 with the latch 108, as discussed above, to one or both of the outside and inner wall portions that will be the first lid wall 104. The locking tab 310 may be depressed or displaced to allow for the plate 202 to slide into the window 308 such that the parallel edge portions of the window are disposed within the groove 210 of the plate 202. Parallel edge portions of the window 308 guide the plate 202 into position within the inner wall portion 104B.

When the plate 202 is fully inserted into the window 308, the locking tab 310 may be moved back into place to lock the plate 202 into position with the inner wall portion 104B. The plate 202 may be disposed such that when the inner wall portion 104B is folded over the outer wall portion 104A, the latch 108 is disposed within the aperture 106. In this way, the plate 202 may be coupled to the first box part 100 in a substantially fixed position via contact with the first lid wall 104 while still allowing the latch 108 to slide within the apertures 106, 120. Further, the plate 202 may be substantially hidden from view by being behind the outer wall portion 104A.

The locking tab 310 is a component of the packaging system capable of laying in plane with and indistinguishable from the surrounding first lid wall 104 when positioned to secure the latch assembly 107 in place. Additionally, the locking tab 310 may be displaced or removed from the first lid wall 104 to insert the latch assembly 107 within the window 308. The locking tab 310 may either be an inherent part of the first box part 100 as shown in FIG. 3. An inherent part of the first box part 100 may be connected to the first box part 100 on only one side of the locking tab 310 with the remaining sides disconnected from any other component. The locking tab 310 may have a vertical dimension greater than the vertical dimension of the window 308 to enable a plate 202 to be slidably inserted within the window 308 by fitting the border of the window 308 inside the groove 210.

For example, in the exemplary embodiment of FIG. 3, the locking tab 310 is part of the first blank 302 and is formed by cutting the first blank 302 along a series of lines extending from the window thereby resulting in a segment of the first blank 302 that is connected to the first blank 302 on only one side.

The other three sides of the locking tab 310 are disconnected from the first blank 302. For instance, the locking tab 310 of FIG. 3 may be created by beginning an incision from the top and bottom left corners of the window 308 in the vertical direction. The incision may then be continued in the horizontal direction after adequately cutting along the vertical direction. The vertical dimension of the locking tab 310 may be greater than the vertical dimension of the plate 202 such that the locking tab will not prevent the plate 202 from being inserted within the window 308.

The respective vertical incisions may be the same such that the center of the folding tab is aligned with the center of the window. Similarly, the respective horizontal incisions may be the same such that the folding line of the locking tab 310 is parallel with the horizontal lines of the window 308. Other possibilities exist that are capable of providing an access point to the window 308 and securing the inserted component in place.

The addition of the groove 210 in the improved latch assembly 107 allows the latch assembly 107 to be more securely incorporated and coupled with the first box part 100 by slidably inserting the latch assembly 107 into the window such that the first box part 100 is sandwiched between the front and back face of the plate 202. Because the front and back faces of the plate 202 are part of one unitary piece of manufacture, unlike other latch assemblies where the front and back plates are snapped together, the front and back face cannot become uncoupled which would result in the latch assembly 107 becoming uncoupled from the first box part 100 thereby compromising the structural integrity of the packaging system, meaning that the packaging system will remain secure during transit.

Other steps may also be performed at block 506, such as coupling one or more fasteners or securing means to the first blank 302 that may facilitate forming the first box part 100. Other examples are also possible. Further, block 506 or an additional block in the method 500, may separately involve coupling a channel liner 204 to the second blank 402. The channel liner 204 is the manufactured article defining the guide channel 113 in which the latch 108 may slide, as shown in FIGS. 2A-2D. Other components may also be added, such as fasteners that may facilitate forming the second box part 102.

Block 508 of the method 500 in FIG. 5, may involve forming the first box part 100 from the first blank 302 through the method 600 in FIG. 6. This may include folding the first blank 302 along the scored lines 304A-L and substantially fixing the plurality of lid walls in place by, for example, tucking one or more flaps into one or more slots formed by the folded portions of the first blank 302. Forming the first box part 100 may further involve gluing portions of one or more lid walls together, or fastening one or more fasteners that may have been added to the first blank before the first box part was formed. Other possibilities exist.

Additionally, the first blank 302 may be folded along folding lines 304L, 304H such that the finger tab 109 protrudes through the aperture 106 and is accessible from the exterior of the first box part 100 and the interior flange 220 protrudes into the interior of the formed first box part 100.

In some examples, disposing the latch assembly 107 within the window 308 at block 606 may occur before the first box part 100 is assembled at block 508. Alternatively, disposing the latch assembly 107 within the window 308 may occur after the assembly of the first box part 100. Similarly, coupling a channel liner 204 to the second blank 402 may occur either before or after assembling the second box part 102, which is discussed below at block 510. Additional examples are also possible.

Block 510 of the method 500 shown in FIG. 5, may involve forming the second box part 102 from the second blank 402, which may include one or more of the actions just discussed with respect to the first box part 100. For example, the second blank 402 may be folded along the scored lines 404A-H and flaps may be tucked into slots created by the folded portions of the second blank 402 to fix the tray walls in place. Further, the second box part 102 may be formed to fit within the first box part 100 such that the assembly channel segments 114 and locking channel segments 116 are aligned with the latch 108 and aperture 106 as discussed above with respect to FIG. 1A.

Referring back to FIGS. 1B, 2A-2D, the second box part 102 may be configured to fit within the first box part 100 when the guide channel 113 is aligned with the latch 108, or more particularly, the latch engagement portion 224 is aligned with the guide channel 113 when the latch 108 is in a first position within the aperture 106. For example, as shown in FIG. 1B, the finger tab 109 of the latch 108 is on the right side of the aperture 106, thereby aligning the latch engagement portion 224 with the guide channel 113. On the first lid wall 104, near the right side of the aperture 106, is an icon indicating that the latch 108 is "unlocked" when it is in this first position.

Figure 7:
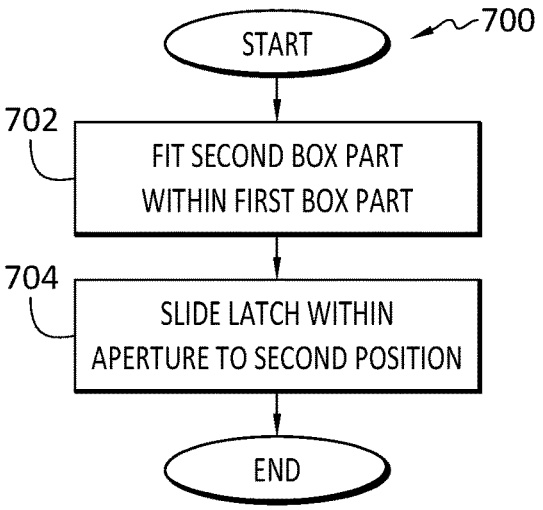
FIG. 7 shows a flow diagram according to an exemplary implementation.

Accordingly, in the example method 700 shown in FIG. 7, block 702 may involve fitting the second box part 102 within the first box part 100, as discussed above. Alternatively, in some implementations, the first box part 100 may be configured to fit within the second box part 102.

Referring back to FIGS. 1B, the second box part 102 is fitted within the first box part 100 and has been lowered onto the second box part 102 such that the second box part 102 is fully seated within the first box part 100 and the tray walls of the second box part 102 are no longer visible. Referring to FIGS. 1A and 1B together, as the first box part 100 is lowered into the position shown in FIG. 1B, the assembly channel segment 114 guides the latch 108 in a generally vertical direction, but restricts movement of the latch 108 in other directions.

When the second box part 102 is fully seated within the first box part 100, the latch 108 is substantially aligned with the locking channel segment 116. When the second box part 102 is ultimately seated in the position shown in FIG. 1B, the finger tab 109 may generally be horizontally slidable within the aperture 106 and within the locking channel segment 116 to a second position away from the unlocked first position. When moved away from the unlocked position, the finger tab 109 and corresponding latch 108 are generally restricted from movement in directions other than horizontal directions.

Further, the latch engagement portion 224 of latch 108 that extends into the second box part 102 may resist the separation of the box parts via contact with the first tray wall 110. Accordingly, on the first lid wall 104, near the left side of the aperture 106, is an icon indicating that the latch 108 is "locked" when it is in this second position.

In some examples, the first lid wall 104 may include a guide projection (not shown) positioned such that the guide projection aligns with the channel assembly segment 114 when the second box part 102 is fitted within the first box part 100. This may be used to help avoid ambiguity in the alignment of the first and second box parts 100, 102 in an exemplary packaging system that has multiple latches 108. A guide projection may be located on the interior of the first lid wall 104, positioned such that it is aligned with the assembly channel segment 114 of the first tray wall 110. The latch 108 may be in an intermediate position within the aperture 106. However, it should be recognized that the latch 108 would have to be moved to the "unlocked" position under the guide projection for the box parts to be fitted together.

The guide projection may be part of the plate 202, although other examples are also possible. In an implementation of the first lid wall 104 that does not include a plate 202, the guide projection may be coupled to a different component of the first lid wall 104. Other possibilities also exist.

Block 704 of the method 700 shown in FIG. 7 may involve sliding the finger tab 109 within the aperture 106 to the second position, where sliding the finger tab 109 within the aperture 106 also includes sliding the latch 108 within the locking channel segment 116.

Referring back to FIG. 1A, in some examples, as discussed above, the aperture 106 may include more than one line or arc segment, and the finger tab 109 may be slidable within the aperture 106 along more than one axis. In such cases, the locking channel segment 116 may include a corresponding configuration of line or arc segments, and the finger tab 109 may be further slidable within the locking channel segment 116.

In some exemplary packaging systems, a first box part 100 may include more than one latch 108 as discussed above, and the second box part 102 may include more than one guide channel 113 configured and dimensioned to receive each respective latch 108. For instance, a pair of latches 108 may be positioned on the farthest ends of a cuboid shape that has length greater than its height or width. Other arrangements and configurations are also possible.

Returning to FIG. 1A, it may be assumed for purposes of explanation that the side of the first box part 100 opposite the first lid wall 104 includes a second aperture and a second latch, and that the second box part 102 includes a corresponding channel region 112 on the wall opposite the first tray wall 110. In such an arrangement, it may be desirable to configure the latches 108 (and the corresponding channel regions 112) such that the latches 108 slide in the same relative direction to the "locked" or "unlocked" position within their respective apertures 106. Thus, a person with the exemplary packaging system in front of them might slide both latches forward (away from the person) to "unlock" the latches, and back (toward the person) to "lock" the latches.

The invention claimed is:

1. A packaging system comprising:

a first box part having a plurality of lid walls, at least one of the plurality of lid walls being a first lid wall defining a first aperture having a first end and a second end;

a second box part configured and dimensioned to fit within the first box part, the second box part having a plurality of tray walls, at least one of the plurality of tray walls being a first tray wall defining a guide channel; and a latch assembly slidably disposed within the first aperture, the latch assembly having a single plate with an integrated groove and a latch, the integrated groove configured to retain the latch assembly;

wherein the single plate comprises a front face, a rear face, and an inner rim located between the front face and the rear face, the inner rim defining a slot, and a flap extending from the inner rim of a frame, the flap defining a second aperture;

wherein the latch comprises a projection portion, a body portion, and an engagement portion, the latch slidably inserted into the slot such that the second aperture fits around the projection portion.

2. The packaging system of claim 1, wherein the first box part and second box part are secured together by fitting the second box part within the first box part while the latch is positioned at the first end of the first aperture such that the latch slides past the guide channel, and subsequently positioning the latch to the second end of the first aperture.

3. The packaging system of claim 1, wherein the first lid wall further comprises first and second adjacent walls, and wherein the first adjacent wall defines the first aperture, and the second adjacent wall further comprises a locking tab and defines a window.

4. The packaging system of claim 3, wherein the first lid wall is formed by folding the second adjacent wall over the first adjacent wall such that the first aperture and window are aligned.

5. The packaging system of claim 4, wherein the latch assembly is disposed within the window.

6. The packaging system of claim 5, wherein the first lid wall further forms a locking flap, wherein the locking tab is positioned to secure the latch assembly within the window.

7. The packaging system of claim 3, wherein the first aperture and the window are substantially aligned with the latch.

8. The packaging system of claim 1, wherein the latch is slidable within the first aperture along a single axis.

9. The packaging system of claim 7, wherein the guide channel comprises a plurality of axes corresponding with the plurality of axes of the first aperture.

10. The packaging system of claim 1, wherein the latch is slidable within the first aperture along a plurality of axes.

* * * * *